United States Patent [19]

Stadele et al.

[11] Patent Number: 4,984,422

[45] Date of Patent: Jan. 15, 1991

[54] TEXTILE TUBE SUPPORT DEVICE HAVING POSITION INDICATING MEANS

[75] Inventors: Norbert Stadele, Goppingen; Martin Maeser, Albershausen, both of Fed. Rep. of Germany

[73] Assignee: Zinser Textilmaschinen GmbH, Fed. Rep. of Germany

[21] Appl. No.: 448,884

[22] Filed: Dec. 12, 1989

[30] Foreign Application Priority Data

Dec. 12, 1988 [DE] Fed. Rep. of Germany ..... 3841812

[51] Int. Cl.[5] ..... D01H 9/18; B65H 67/06

[52] U.S. Cl. ..... 57/281; 57/264; 57/276; 242/35.5 A

[58] Field of Search ..... 57/264, 265, 276, 270, 57/281; 242/35.5 R, 35.5 A

[56] References Cited

U.S. PATENT DOCUMENTS

| | | | |
|---|---|---|---|
| 4,660,371 | 4/1987 | Matsui et al. | 57/281 |
| 4,730,450 | 3/1988 | Tone | 242/35.5 R X |
| 4,813,222 | 3/1989 | Fukuda et al. | 57/276 X |
| 4,838,019 | 6/1989 | Ueda | 57/264 |
| 4,875,572 | 10/1989 | Kiriake | 242/35.5 A X |

FOREIGN PATENT DOCUMENTS

| | | |
|---|---|---|
| 2433848 | 2/1975 | Fed. Rep. of Germany . |
| 3344473 | 6/1984 | Fed. Rep. of Germany . |
| 3628045 | 3/1987 | Fed. Rep. of Germany . |
| 3742112 | 6/1988 | Fed. Rep. of Germany . |

*Primary Examiner*—John Petrakes

*Attorney, Agent, or Firm*—Shefte, Pinckney & Sawyer

[57] ABSTRACT

A textile machine includes a plurality of tube support devices transported by a transport device to a tube transfer position for transfer of tubes between the tube support devices and a tube handling device. The tube support devices each include an upright member for individually supporting a tube in a substantially upright disposition, the upright member having a recess and an indicator device disposed within the recess. The indicator device cooperates with the transport device to indicate the presence of the upright member at an indicating position located at a predetermined location with respect to the tube transfer position. Accordingly, the transport device determines the presence of an upright member and responds accordingly to reliably position the upright member at the tube transfer position for transfer of the tube between the upright member and the tube handling device.

16 Claims, 1 Drawing Sheet

TEXTILE TUBE SUPPORT DEVICE HAVING POSITION INDICATING MEANS

BACKGROUND OF THE INVENTION

The present invention relates to a textile tube support device having position indicating means and, more particularly, a textile support device for supporting a tube in an upright disposition and having indicating means for indicating the presence of the tube support device at a predetermined location.

It is known to transport tubes on which yarn packages are built and to transport empty tubes on a plurality of tube support devices. One known transport device is configured to transport the tube support devices to a predetermined location for a tube transfer operation in which, alternatively, tubes having yarn packages built thereon or empty tubes are transferred from the tube support devices to a further handling device or tubes having yarn packages built thereon or empty tubes are transferred onto the tube support devices. In this known device, the tube support devices are of the type having an upright member for snugly receiving a tube inserted thereon to support the tube in an upright disposition during transport of the tube.

As can be understood, the upright member of a tube support device undergoing a tube transfer operation must be relatively precisely positioned with respect to the tube transfer device to insure that the tube transfer device can reliably insert a tube onto, or remove a tube from, the upright member. In this regard, it is known to use mechanical or optical sensors for detecting the position of an upright member relative to the tube transfer device. However, operating conditions such as, for example, the dust and debris which is invariably present in the textile environment, negatively influence the sensing capabilities of such mechanical and optical sensors. As a result, the upright members of the tube support devices cannot be reliably positioned with respect to the tube transfer device.

Additional difficulties arise with the transport of tubes in that it is difficult to automatically distinguish between those upright members which are supporting empty tubes and those upright members which are supporting tubes having yarn packages built thereon since, in both cases, the upright members are identical. However, it is beneficial to have the capability to distinguish between those upright members supporting empty tubes and other upright members supporting tubes with yarn packages thereon in certain textile processes. For example, one textile process involves the supplying of an empty tube only to every other upright member which is transported past the tube transfer device. In such a textile process, it would be advantageous to have the capability to distinguish among the upright members to identify those upright members which are to receive an empty tube.

SUMMARY OF THE INVENTION

The present invention provides a tube support device having an upright member which cooperates with a tube transport device to insure that the upright member is reliably positioned at a tube transfer position for transfer of a tube by a tube transfer device between the upright member and a tube handling device. Moreover, the present invention provides a tube transfer positioning apparatus which allows predetermined ones of the tube support devices to be identified.

Briefly described, the present invention provides a tube support device for a textile machine having a plurality of tubes adapted to support windings of textile material thereon, a plurality of tube support devices for individually supporting the tubes, a tube transfer device at a tube transfer position for transferring tubes between the tube support devices and a tube handling device and a transport device for transporting the tube support devices to the tube transfer position for tube transfer operations by the tube transfer device. The tube transfer device includes an upright member for individually supporting a tube in a substantially upright disposition, the upright member having a recess; and indicator means disposed within the recess, the indicator means cooperating with the transport device to indicate the presence of the upright member at a sensing position located at a predetermined location with respect to the tube transfer position whereby the transport device reliably positions each tube support device at the tube transfer position for transfer of a tube between the upright member and the tube handling device.

In one form in which the transport device includes a moving belt having a throughbore and a fastener assembly adapted to extend through the throughbores for securing the upright members to the moving belt, the upright member includes an axial bore for receiving a fastener assembly therein for securing the upright member to the moving belt and the recess is disposed between the axial bore and the periphery of the upright member. The indicator means is preferably formed of metal so that the sensing can be magnetic.

According to one aspect of the present invention, the recess is a first recess disposed laterally of the axial bore with respect to the direction of travel of the moving belt and a second recess disposed laterally opposite the first recess with respect to the axial bore, and the indicator means includes a pair of vertically extending members received in the recesses. The vertically extending members of the indicator means are interconnected by a connector member, the connector member including a throughbore for receiving the fastener assembly therethrough. The throughbore of the indicator means is preferably formed with a non-annular contour compatibly configured with the upright member for engagement therewith to resist rotation of the indicator means.

In the preferred embodiment, the aforesaid tube support device is combined with a sensing device that includes a first sensing component operatively connected to the transport device and with the aforesaid indicator means being a second sensing component. In this embodiment, the first sensing component includes means for sensing the passage therepast of the second sensing component whereby the transport device responds to the sensing of the second sensing component by the first sensing component to reliably position the upright member at the tube transfer position for transfer of a tube between the upright member and the tube handling device.

In one form, the transport device includes a moving belt having a throughbore and a fastener assembly adapted to extend through the throughbore for securing the upright member to the moving belt and the upright member includes an axial bore for receiving the fastener assembly therein for securing the upright member to the moving belt and the recess is disposed between the axial bore and the periphery of the upright member. The second sensing component is preferably formed of metal and the first sensing component magnetically senses the second sensing component.

According to one aspect of the present invention, the recess is a first recess disposed laterally of the axial bore with respect to the direction of travel of the moving belt, the upright member includes a second recess disposed laterally opposite the first recess with respect to the axial bore and the second sensing component includes a pair of vertically extending members being received in a respective one of the recesses. Each of the vertically extending members has a generally planar surface and the vertically extending members are received in the recesses with the generally planar surfaces generally parallel to the direction of travel of the moving belt. The vertically extending members of the second sensing component are interconnected by a connector member and the connector member includes a throughbore for receiving the fastener assembly therethrough.

According to a further aspect of the present invention, the throughbore of the second sensing component is formed with a non-annular contour compatibly configured with the upright member for engagement therewith to resist rotation of the second sensing component. In another aspect of the present invention, the second sensing component is formed of metal laminations and the first sensing component magnetically senses the second sensing component.

Accordingly, the present invention provides a tube transfer positioning apparatus which is capable of distinguishing between the tube support devices by providing only selected tube support devices with the second sensing component. The tube transfer positioning apparatus would thus sense only those tube support devices having the second sensing component.

DETAILED DESCRIPTION OF THE PREFERRED EMBODIMENT

Figure 1:
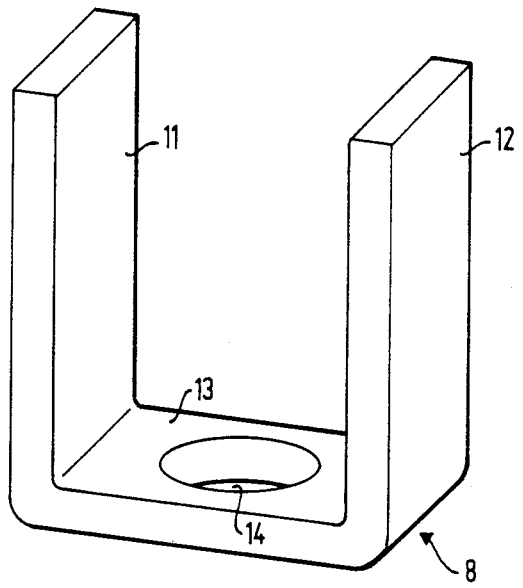
FIG. 1 is a perspective view of one form of the indicator means of one embodiment of the tube support device of the present invention.
Figure 3:
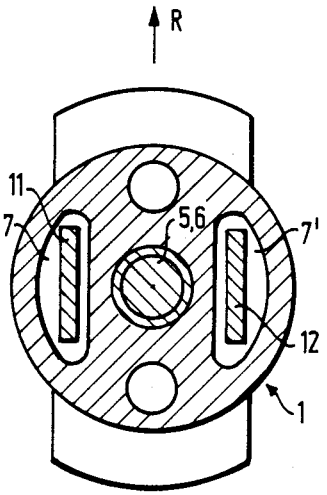
FIG. 3 is a horizontal sectional view of the tube support device shown in FIG. 2, taken along lines III—III.
Figure 2:
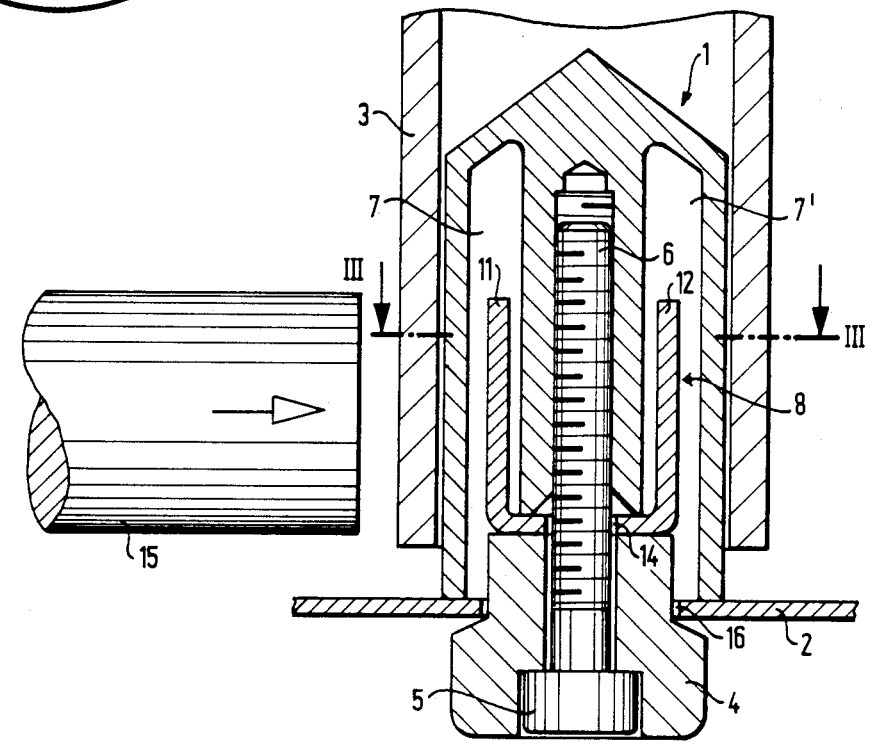
FIG. 2 is a vertical sectional view of one embodiment of the tube support device supported on the moving belt of a tube transport device for transport past a sensing device.

In FIGS. 1-3, the preferred embodiment of the tube support device 1 of the present invention is illustrated. The tube support device 1 is adapted to individually support a conventional tube 3 of the type onto which textile material such as, for example, yarn is wound. A textile machine (not shown) includes a conventional transport device having a conventional moving endless belt 2 for transporting the tube support devices 1 to a tube transfer position. A conventional tube transfer device for transferring tubes (not shown) transfers a tube at the tube transfer position between the tube support device 1 and a conventional tube handling device (not shown) for further handling of the tube.

The moving belt 2 includes a throughbore 16. The transport device includes a fastener assembly having a collar member 4 adapted to extend through the throughbore 16 and having an axial throughbore with a bolt 5 extending therethrough. The axial throughbore of the collar member 4 includes a radially enlarged lower portion forming an annular shoulder with the upper portion of the throughbore. The bolt 5 has a threaded portion adapted to be inserted through the axial throughbore of the collar member 4 and a radially enlarged head portion adapted to engage the annular shoulder of the axial bore of the collar member 4 to prevent axial movement in an upward direction of the bolt 5.

As seen in FIGS. 2 and 3, the tube support device 1 includes an upright member having a body portion which is cylindrically shaped and a conically tapering top portion. The circumferential periphery of the upright member of the transport device 1 is compatibly configured with the inner diameter of the tube 3 such that the tube 3 is snugly received on the upright member. The tube support device 1 includes an axial threaded bore 6 adapted to threadably receive the threaded portion of the bolt 5. The bolt 5 is appropriately threaded in the axial threaded bore 6 to cause the moving belt 2 to be compressively gripped between the bottom of the tube support device 1 and the collar member 4, whereby the tube support device 1 is fixedly connected to the moving belt 2 for movement therewith.

The tube support device 1 includes a first recess 7 disposed laterally of the axial bore 6 with respect to the direction of travel R of the moving belt 2, a second recess 7′ disposed laterally opposite the first recess 7 with respect to the axial bore 6 and an indicator means 8. As seen in FIG. 1, the indicator means 8 is formed as an integral metal piece having a U-shape and includes a pair of vertically extending members 11, 12, each having a generally planar surface, interconnected by a connector member 13. The indicator means 8 additionally includes a throughbore 14 for the receipt therethrough of the bolt 5.

As seen in FIGS. 2 and 3, the vertically extending member 11 is disposed in the first recess 7 and the vertically extending member 12 is disposed in the second recess 7′. As seen in FIG. 2, the bolt 5 extends through the throughbore 14. As seen in FIG. 3, the generally planar surface of the vertically extending member 11 and the generally planar surface of the vertically extending member 12 are generally parallel to the direction of travel R of the moving belt 2.

In operation, the tube support device 1 is transported by the moving belt 2 of the transport device in the direction of travel R of the moving belt 2. In accordance with the particular phase of the textile operation, the tube support device 1 either supports the tube 3 in a generally upright disposition or does not have a tube thereon. The tube 3 may be an empty tube or may have windings of yarn disposed thereon. The moving belt 2 transports the tube support device 1 to the tube transfer position at which the tube transfer device selectively, depending on its functional location in the machine, transfers the tube 3 from the tube support device 1 to the tube handling device (if the tube 3 is disposed on the tube support device 1) or transfers a tube from the tube handling device to the tube support device i (if the tube support device 1 arrives at the tube transfer position without a tube supported thereon). Prior to or upon reaching the tube transfer position, the tube support device 1 is transported past a conventional sensing device 15 located at an indicating position which is at a predetermined location with respect to the tube transfer position. The sensing device 15 senses, in conventional manner, the indicating means 8, for example, by magnetically sensing the metal characteristics thereof. The sensing device 15 is operatively connected to the transport device and the transport device responds to the sensing of the indicator means 8 by the sensing device 15 to stop the movement of the moving belt 2 at the tube transfer position in a conventional manner. Accordingly, the tube support device 1 is reliably positioned at the tube transfer position for transfer of a tube between the upright member of the tube support device and the tube handling device.

The present invention also contemplates that a plurality of the tube support devices 1 can be provided, each having an indicator means 8, interspersed with other tube support devices which do not have indicator means. For example, the tube support devices 1 can be disposed along the moving belt 2 in alternating fashion with tube support devices not having an indicator means. Accordingly, the indicator means 8 would be operable for positioning of its associated tube support device 1 at the tube transfer position while tube support devices without indicator means would not be sensed and therefore would pass through the tube transfer position without a tube transfer operation.

The present invention further contemplates that the throughbore 14 of the indicator means 8 can be formed with a conventional non-annular contour compatibly configured with a non-annular contour on the upright member for engagement therewith to resist rotation of the indicator means 8.

The present invention additionally contemplates that the tube support device 1 can be formed with only a single recess in which an appropriately configured form of the indicator means 8 is disposed. Moreover, the present invention contemplates that the indicator means 8 can be formed of metal laminations.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile machine having a plurality of tubes adapted to support windings of textile material thereon, a plurality of tube support devices for individually supporting the tubes, a tube transfer device at a tube transfer position for transferring tubes between the tube support devices and a tube handling device and a transport device for transporting the tube support devices to the tube transfer position for tube transfer operations by the tube transfer device, each tube support device comprising:

an upright member for individually supporting a tube with said upright member projecting into the tue for support thereof in a substantially upright disposition, said upright member having an interior recess extending upwardly therein; and indicator means disposed within said recess, said indicator means being readable through said upright member and cooperating with the transport device to indicate the presence of said upright member at a sensing position located at predetermined location with respect to the tube transfer position whereby the transport device reliably positions each tube support device at the tube transfer position for transfer of a tube between said upright member and the tube handling device.

2. In a textile machine having a plurality of tubes adapted to support windings of textile material thereon, a plurality of tube support devices for individually supporting the tubes, a tube transfer device at a tube transfer position for transferring tubes between the tube support devices and a tube handling device and a transport device for transporting the tube support devices to the tube transfer position for tube transfer operations by the tube transfer device, the transport device including a moving belt having a throughbore and a fastener assembly adapted to extend through the throughbore, each tube support device comprising:

an upright member for individually supporting a tube in a substantially upright disposition, said upright member having a recess and an axial bore for receiving the fastener assembly therein for securing said upright member to the moving belt, said recess being disposed between said axial bore and the periphery of said upright member; and indicator means disposed within said recess, said indicator means cooperating with the transport device to indicate the presence of said upright member at a sensing position located at predetermined location with respect to the tube transfer position whereby the transport device reliably positions each tube support device at the tube transfer position for transfer of a tube between said upright member and the tube handling device.

3. In a textile machine, the tube support device according to claim 1 and characterized further in that said indicator means is formed of metal.

4. In a textile machine, the tube support device according to claim 2 and characterized further in that said recess is a first recess disposed laterally of said axial bore with respect to the direction of travel of the moving belt, said upright member includes a second recess disposed laterally opposite said first recess with respect to said axial bore and said indicator means includes a pair of vertically extending members being received in a respective one of said recesses.

5. In a textile machine, the tube support device according to claim 4 and characterized further in that each of said vertically extending members has a generally planar surface and said vertically extending members are received in said recesses with said generally planar surfaces generally parallel to the direction of travel of the moving belt.

6. In a textile machine, the tube support device according to claim 4 and characterized further in that said vertically extending members of said indicator means are interconnected by a connector member and said connector member includes a throughbore for receiving the fastener assembly therethrough.

7. In a textile machine, the tube support device according to claim 6 and characterized further in that said throughbore of said indicator means is formed with a non-annular contour compatibly configured with said upright member for engagement therewith to resist rotation of said indicator means.

8. In a textile machine, the tube support devices according to claim 1 and characterized further in that said indicator means is formed of metal laminations.

9. In a textile machine having a plurality of tubes adapted to support windings of textile material thereon, a plurality of tube support devices for individually supporting the tubes, a tube transfer device at a tue transfer position for transferring tubes between the tube support devices and a tube handling device, and a transport device for transporting the tube support devices to the tube transfer position for tube transfer operations by the tube transfer device, a tube transfer positioning apparatus comprising:

an upright member for individually supporting a tube with said upright member projecting into the tube for support thereof in a substantially upright disposition, said unright member having an interior recess extending upwardly therein; and a sensing device for sensing the presence of said upright member at a sensing position located at a predetermined location wit respect to the tube transfer position, said sensing device including a first sensing component operatively connected to the transport device and a second sensing component disposed in said recess, said first sensing component including means for sensing through said upright member the presence of said second sensing component whereby the transport device responds to the sensing of said second sensing component by said first sensing component to reliably position said upright member at the tube transfer position for transfer of a tube between said upright member and the tube handling device.

10. In a textile machine having a plurality of tubes adapted to support windings of textile material thereon, a plurality of tube support devices for individually supporting the tubes, a tube transfer device at a tube transfer position for transferring tubes between the tube support devices and a tube handling device and a transport device for transporting the tube support devices to the tube transfer position for tube transfer operations by the tube transfer device, the transport device including a moving belt having a throughbore and a fastener assembly adapted to extend through the throughbore, each tube support device comprising:

an upright member for individually supporting a tube in a substantially upright disposition, said upright member having a recess and an axial bore for receiving the fastener assembly therein for securing said upright member to the moving belt, said recess being disposed between said axial bore and the periphery of said upright member; and a sensing device for sensing the presence of said upright member at a sensing position located at a predetermined location with respect to the tube transfer position, said sensing device including a first sensing component operatively connected to the transport device and a second sensing component disposed in said recess, said first sensing component including means for sensing the presence thereat of said second sensing component whereby the transport device responds to the sensing of said second sensing component by said first sensing component to reliably position said upright member at the tube transfer position for transfer of a tube between said upright member and the tube handling device.

11. In a textile machine, the tube transfer positioning apparatus according to claim 9 and characterized further in that said second sensing component is formed of metal and said first sensing component magnetically senses said second sensing component.

12. In a textile machine, the tube transfer positioning apparatus according to claim 10 and characterized further in that said recess is a first recess disposed laterally of said axial bore with respect to the direction of travel of the moving belt, said upright member includes a second recess disposed laterally opposite said first recess with respect to said axial bore and said second sensing component includes a pair of vertically extending members being received in a respective one of said recesses.

13. In a textile machine, the tube transfer positioning apparatus according to claim 12 and characterized further in that each of said vertically extending members has a generally planar surface and said vertically extending members are received in said recesses with said generally planar surfaces generally parallel to the direction of travel of the moving belt.

14. In a textile machine, the tube transfer positioning apparatus according to claim 12 and characterized further in that said vertically extending members of said second sensing component are interconnected by a connector member and said connector member includes a throughbore for receiving the fastener assembly therethrough.

15. In a textile machine, the tube transfer positioning apparatus according to claim 14 and characterized further in that said throughbore of said second sensing component is formed with a non-annular contour compatibly configured with said upright member for engagement therewith to resist rotation of said second sensing component.

16. In a textile machine, the tube transfer positioning apparatus according to claim 9 and characterized further in that said second sensing component is formed of metal laminations and said first sensing component magnetically senses said second sensing component.

* * * * *